United States Patent [19]

Kanjo et al.

[11] Patent Number: 4,645,187

[45] Date of Patent: Feb. 24, 1987

[54] DRAFT GEAR ASSEMBLY

[75] Inventors: Wajih Kanjo, Midlothian; Howard R. Sommerfeld, Oak Forest, both of Ill.

[73] Assignee: American Standard Inc., Chicago, Ill.

[21] Appl. No.: 650,932

[22] Filed: Sep. 14, 1984

[51] Int. Cl.[4] ..... B60G 15/04

[52] U.S. Cl. ..... 267/9 A; 213/33; 384/912

[58] Field of Search ..... 267/9 A, 9 B, 9 C; 213/22, 24, 29, 33, 34, 32 B; 252/12.4; 308/241, DIG. 8; 384/594, 595, 912; 148/36

[56] References Cited

U.S. PATENT DOCUMENTS 2,815,201 12/1957 Girod-Eymery ..... 267/9 B
2,916,163 12/1959 Campbell ..... 213/33
3,178,036 4/1965 Cardwell ..... 213/33
3,447,693 6/1969 Cardwell ..... 213/22

*Primary Examiner*—George E. A. Halvosa
*Assistant Examiner*—Robert J. Oberleitner
*Attorney, Agent, or Firm*—J. O. Ray, Jr.

[57] ABSTRACT

The present invention discloses a draft gear assembly including a housing having a front and a rear portion. A compressible cushioning element is positioned in the rear portion with a seat arrangement abutting one end thereof. A friction cushioning element having a pair of outer stationary plates with a Brinell through hardness of between about 277 and 321. The assembly also includes a spring release device for continuously urging the friction cushioning element outwardly from the compressible cushioning element to release the friction cushioning element after compression of the draft gear assembly.

16 Claims, 6 Drawing Figures

DRAFT GEAR ASSEMBLY

BACKGROUND OF THE INVENTION

The present invention relates in general to draft gear assemblies for cushioning shocks in railway rolling stock and, more particularly, to a lighter weight draft gear assembly which retains the same shock absorbing capacity.

Draft gear assemblies in use prior to the present invention are taught in U.S. Pat. Nos. 2,916,163; 3,178,036 and 3,447,693 and are owned by the assignee of the present invention. The above identified patents are all incorporated herein by reference.

In order to reduce the weight of railroad cars, it is desirable to keep the weight of auxiliary equipment low on such cars at a minimum. The draft gear in the prior art reference patents all weighed about 386 pounds or more. There are two reasons why lighter weight draft gears are desirable. First, less energy is required to move the railroad car and secondly more payload can be carried by such car for the same amount of energy.

However, even though it has been known that a lighter weight draft gear was desirable for these reasons, such draft gear must maintain minimum shock absorbing capacity as specified by the Association of American Railroads (A.A.R.) standards. For example, these gears have a specified capacity of at least 36,000 foot pounds. It is also important to note that the action of the friction system permits this to be accomplished without exceeding a 500,000 pound reaction pressure on the car sills in order for these high energy shocks to be readily handled without upsetting the coupler shank.

SUMMARY OF THE INVENTION

The present invention provides a lightweight draft gear assembly for railroad car stock. The draft gear assembly comprises a housing closed at one end and open at the opposed end. The housing has a rear chamber adjacent the closed end and a front chamber adjacent the open end which is in open communication with said rear chamber.

The housing has a pair of laterally spaced opposed friction surfaces located in the front chamber.

A compressible cushioning element is centrally disposed within the rear chamber with one end thereof abutting at least a portion of an inner surface of the closed end of the housing and extending longitudinally from such one end.

A compressible cushioning element positioning means is positioned adjacent such one end of the compressible cushioning element and the inner surface of such closed end of the housing for maintaining such one end of the compressible cushioning element centrally located in the rear chamber of the housing during compression and extension of such compressible cushioning element.

A seat means with at least a portion of one surface thereof abutting the opposite end of the compressible cushioning element is mounted to move longitudinally within the housing for respectively compressing and releasing the compressible cushioning element during application and release of a force on the draft gear assembly.

A friction cushioning means is positioned at least partially within the front chamber of the housing for absorbing energy during application of a force sufficient to cause a compression of the draft gear assembly. The friction cushioning means includes a pair of laterally spaced stationary outer plates which have an outer friction surface engaging the laterally spaced friction surfaces carried by the housing. The pair of stationary outer plates have a Brinell hardness of between about 277 and 321. The outer friction surface includes at least one recessed area to reduce the frictional surface engaging area between the stationary outer plate and the laterally spaced friction surface carried by the housing, and at the same time decrease relative movement between such stationary outer plate and the housing.

A pair of laterally spaced movable plates having at least a portion of an outer friction surface movably and frictionally engaging an inner friction surface of the stationary outer plate and one edge engaging the seat means.

A pair of laterally spaced tapered stationary plates have an outer friction surface movably and frictionally engaging at least a portion of an inner friction surface of the movable plate.

A pair of laterally spaced wedge shoes having at least a portion of an outer friction surface movably and frictionally engaging at least a portion of an inner friction surface of the tapered stationary plate and at least a portion of one edge engaging the seat means. The pair of wedge shoes have a predetermined tapered portion on at least a portion of an opposed edge thereof.

A center wedge having a pair of matching predetermined tapered portions for engaging the tapered portion of the wedge shoe to initiate frictional engagement of the friction cushioning means and thereby absorb energy.

Also included is a spring release means engaging and longitudinally extending between the seat means and the center wedge for continuously urging the friction cushioning means outwardly from the compressible cushioning means to release such friction cushioning element when an applied force compressing the draft gear is removed.

OBJECTS OF THE INVENTION

It is, therefore, one of the primary objects of the present invention to provide a draft gear assembly which at least meets the A.A.R. standards which is lighter in weight than prior art draft gears.

Another object of the present invention is to provide a lighter weight draft gear assembly which utilizes fewer parts.

Still another object of the present invention is to provide a lighter weight draft gear assembly which does not require modification to present railroad equipment for installation.

These and various other objects and advantages to the present invention will become more apparent to those persons skilled in the railroad design art from the following more detailed description when such description is taken in conunction with the attached drawings and the appended claims.

DESCRIPTION OF THE VARIOUS EMBODIMENTS OF THE INVENTION

The draft gear assembly, according to the present invention, is installed in alignment with a railroad car center sill between a front and a rear draft gear lug. A vertical yoke is connected to a coupler shank by a draft key with a coupler horn spaced from a striking plate and with a front follower member within the yoke which is positioned adjacent to the front lugs, all substantially in accordance with the prior art conventional practice as illustrated in the aforementioned U.S. Pat. No. 2,916,163.

Figure 1:
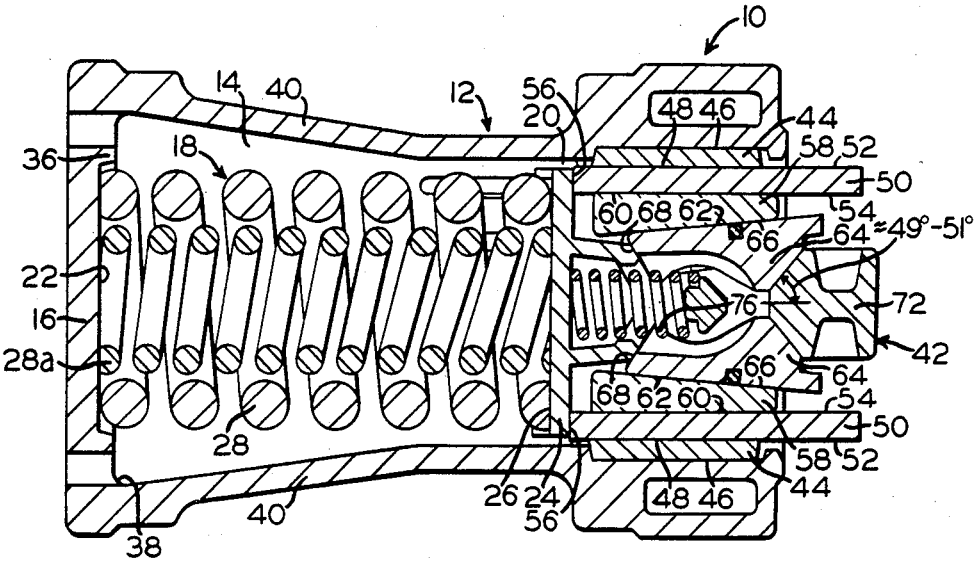
FIG. 1 is a longitudinal cross-sectional view incorporating one form of a presently preferred embodiment of the invention.
Figure 2:
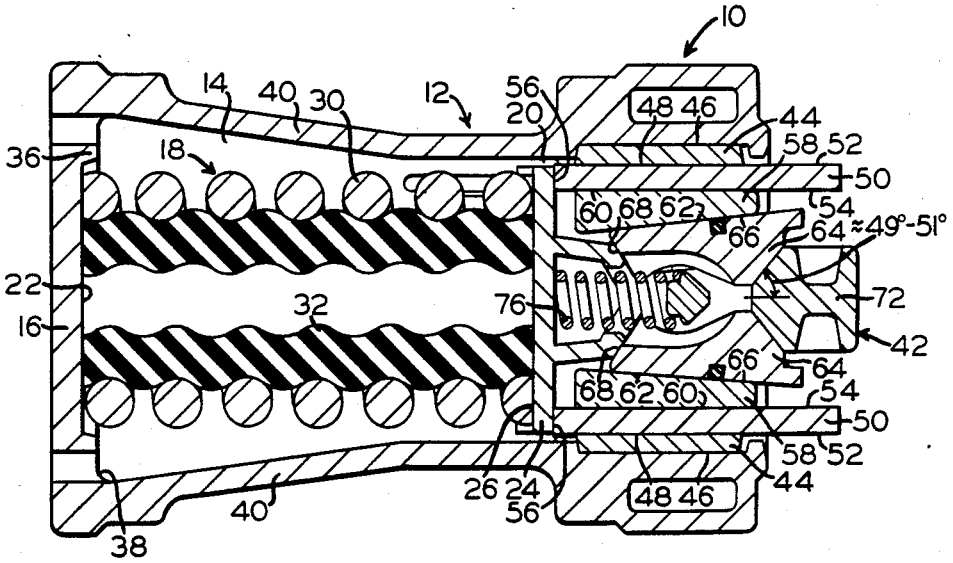
FIG. 2 is a longitudinal cross-sectional view incorporating an alternate embodiment of a compressible cushioning element of a presently preferred embodiment of the invention.
Figure 3:
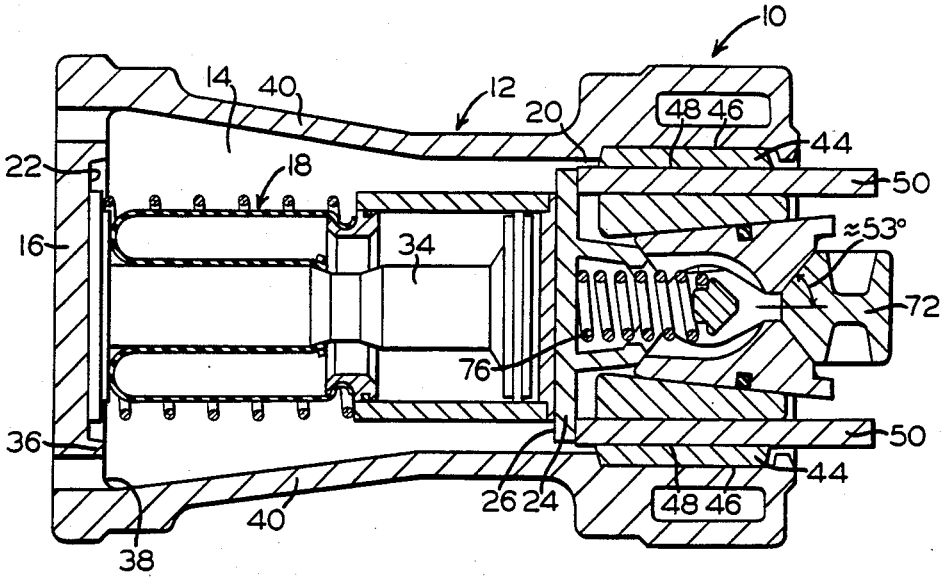
FIG. 3 is a longitudinal cross-sectional view incorporating another alternative embodiment of a hydraulic cushioning element of a presently preferred embodiment of the invention.
Figure 4:
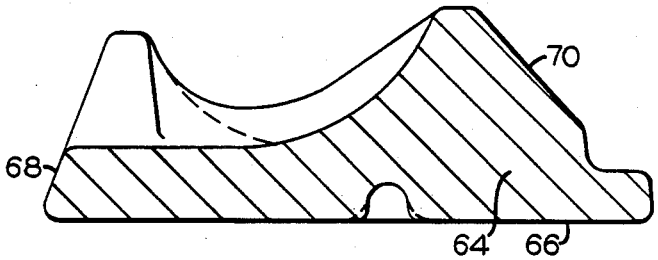
FIG. 4 is a longitudinal cross-sectional view of the wedge shoe showing the required taper.
Figure 5:
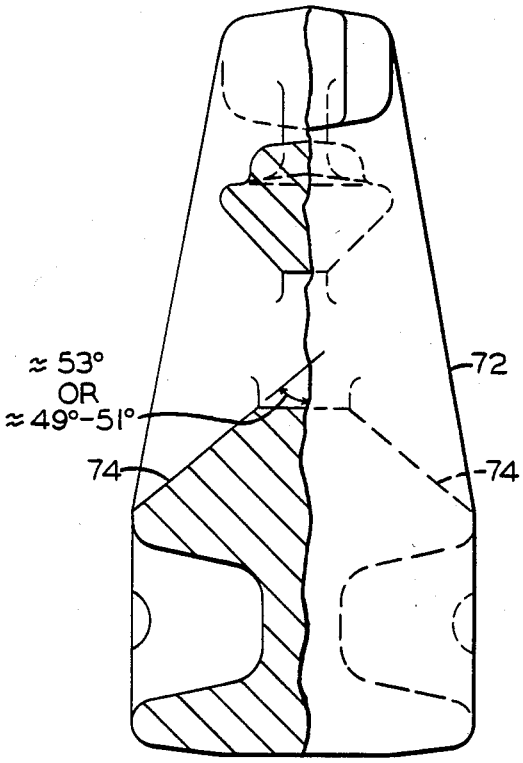
FIG. 5 is a side elevation view partially in cross-section of the center wedge used in the present invention.
Figure 6:
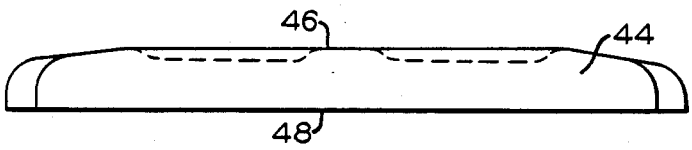
FIG. 6 is a cross-sectional view showing the outer presently preferred stationary plate according to the present invention.

Now referring more particularly to the present invention, as shown in FIGS. 1-3, the draft gear assembly is generally designated as 10. The assembly 10 includes a housing, generally designated as 12. The housing 12 is open at one end and has a rear portion 14 adjacent a bottom wall 16 which closes the other end of housing 12. Rear portion 14 is provided for receiving therein a compressible cushioning means, generally designated as 18. Housing 12 includes a front portion 20 adjacent the open end. Front portion 20 is in open communication with the rear portion 14.

The compressible cushioning element 18 is centrally disposed within the rear portion 14 and has one end thereof abutting at least a portion of an inner surface 22 of the bottom wall 16 of housing 12. The compressible cushioning element 18 extends longitudinally from bottom wall 16 where the opposite end is placed into abutting relationship with at least a portion of one surface 26 of a seat means 24. Seat means 24 is positioned within the housing 12 for longitudinal movement therein for respectively compressing and releasing the compressible cushioning element 18 during application and release of a force on the draft gear assembly 10.

As shown in FIG. 1, the compressible cushioning element 18, according to one embodiment of the invention, comprises at least one and preferably at least two springs 28. FIG. 2 shows an alternative embodiment for a compressible cushioning element 18 which comprises an outer coil spring 30 and an inner rubber spring 32. FIG. 3 shows another alternative embodiment of the invention in which the compressible pressible cushioning element 18 is a hydraulic unit 34 such as taught in U.S. Pat. No. 3,447,693.

A compressible cushioning element 18 positioning means 36 is positioned adjacent the end adjacent the inner surface 22 of the bottom wall 16 of housing 12 for maintaining that end of the compressible cushioning element 18 centrally located within the rear portion 14 of housing 12 during compression and extension of such compressible cushioning element 18. According to one preferred embodiment of the invention, the positioning means 36 comprises a built-up portion 38 in the housing 12 along two opposed sides adjacent the inner surface 22 of the bottom wall 16 and an inner surface of a connecting sidewall 40 of housing 12.

A friction cushioning means, generally designated as 42, is positioned a least partially within the front portion 20 of the housing 12. The friction cushioning means 42 absorbs energy during application of a force sufficient to cause a compression of the draft gear assembly 10.

The friction cushioning means 42 includes a pair of laterally spaced outer stationary plates 44 having an outer surface 46 and an opposed inner friction surface 48. The outer surface 46 engage the housing 12. It is of critical importance for the objectives of the present invention to be met that the outer stationary plates have a Brinell hardness of between about 277 and 321 throughout. It was discovered that at a hardness of less than 277 the draft gear assembly 10 life was unacceptable, and at a hardness of more than 321 the draft gear assembly 10 would not meet the A.A.R. specifications. A pair of laterally spaced movable plates 50 of substantially uniform thickness are also provided. Movable plates 50 have an outer friction surface 52 and an inner friction surface 54 and at least one substantially flat edge 56 intermediate the outer friction surface 52 and the inner friction surface 54 which edge 56 engages the seat means 24. At least a portion of the outer friction surface 52 movably and frictionally engages the inner friction surface 48 of the outer stationary plate 44. A pair of laterally spaced tapered plates 58 are provided. The tapered plates 58 include an outer friction surface 60 and an inner friction surface 62. The outer friction surface 60 movably and frictionally engages at least a portion of the inner friction surface 54 of the movable plate 50. Friction cushioning means 42 further includes a pair of laterally spaced wedge shoes 64 which have at least a portion of an outer friction surface 66 movably and frictionally engaging at least a portion of the inner friction surface 62 of the tapered stationary plate 58. Wedge shoes 64 have at least a portion of one edge 68 engaging seat means 24 and a predetermined tapered portion 70 on an opposed edge thereof. A center wedge 72 is provided which has a pair of matching tapered portions 74 for engaging the tapered portion 70 of the wedge shoe 64 to initiate frictional engagement of the friction cushioning means 42.

It has been discovered that the tapered portions 70 of the wedge shoes 64 and the tapered portions 74 of the center wedge 72 which are tapered upwardly and outwardly from a plane intersecting the longitudinal centerline of the draft gear assembly 10 must be controlled within a very close tolerance of between about 49° and 51°, and preferably between about 49° and 50°, with the optimum of generally 50° when the compressible cushioning means 18 is either the springs 28 or the combination of a spring 30 and a rubber spring 32. Further, it was discovered that the taper must be about 53° when such compressible cushioning element 18 is a hydraulic unit 34.

A spring release means 76 engages and extends longitudinally between the seat means 24 and the center wedge 72 for continuously urging the friction cushioning mean 42 outwardly from the compressible cushioning means 18 to release the friction cushioning means 42 when an applied force compressing the draft gear assembly 10 is removed.

In operation, the buffing shock is transmitted from the coupler through the front follower to the central wedge 72, causing it to act through the wedge shoes 64 and thereby compress all of the cushioning elements simultaneously. These parts will furnish sufficient cushioning for light buffing shocks. After suitable travel, however, the follower will come against the outer ends of the movable plates 50 introducing energy-absorbing friction between the movable plates 50 and the stationary plates 58 and 44 which have been pressed together by the action of the wedge shoes 64. As this action continues, the pressure between the adjacent surfaces of the intercalated plates has been enormously increased due to the fact that the wedge shoes 64 are loaded against the cushioning mechanism 42. The energy absorption and dissipation through friction and compression of the cushioning mechanism continues until the gear is closed including compression of cushioning element 18.

During release of the gear, the compressible cushioning element 18 is maintained in alignment by the seat means 24.

Although the preferred and various alternative embodiments have been shown, it will be obvious to those skilled in the railroad draft gear design art that various other modifications can be made to the invention without departing from the spirit and scope of the attached claims.

We claim:

1. A draft gear assembly to cushion shocks encountered in railroad rolling stock, said draft gear assembly comprising:

(a) a housing closed at one end and open at the opposed end, said housing having a rear portion adjacent said closed end and a front portion adjacent said open end, said front portion being in open communication with said rear portion;

(b) at least one of a spring and a hydraulic compressible cushioning element centrally disposed within said rear portion with one end thereof abutting at least a portion of an inner surface of said closed end of said housing, said compressible cushioning element extending longitudinally from said one end;

(c) a positioning means on said inner surface of said closed end of said housing for maintaining said one end of said compressible cushioning element centrally positioned in said rear portion of said housing during compression and extension of said compressible cushioning element;

(d) a seat means having at least a portion of one surface thereof abutting the opposite end of said compressible cushioning element and mounted to move longitudinally within said housing for respectively compressing and releasing said compressible cushioning element during application and release of a force on said draft gear assembly;

(e) a friction cushioning means positioned at least partially within said front portion of said housing for absorbing energy during a compression of said draft gear assembly, said friction cushioning means including (i) a pair of laterally spaced outer stationary plates having an outer surface and an opposed inner friction surface, said outer surface engaging said housing, said pair of outer stationary plates having Brinell hardness of between about 277 and 321 throughout, (ii) a pair,of laterally spaced movable plates of substantially uniform thickness and having an outer friction surface and an inner friction surface and at least one substantially flat edge intermediate said outer friction and inner friction surfaces, said one edge engaging said seat means, at least a portion of said outer friction surface movably and frictionally engaging said inner friction surface of said outer stationary plate, (iii) a pair of laterally spaced tapered plates having an outer friction and an inner friction surface, said outer friction surface movably and frictionally engaging at least a portion of said inner friction surface of said movable plate, (iv) a pair of laterally spaced wedge shoes having at least a portion of an outer friction surface movably and frictionally engaging at least a portion of an inner friction surface of said tapered plate, and at least a portion of one edge engaging said seat means, said pair of wedge shoes having a predetermined tapered portion which is tapered upwardly and outwardly from a plane intersecting a longitudinal center line of said draft gear assembly at an angle of one of between 49°–51° and an angle of 53° on an opposed edge thereof, and (v) a center wedge having a pair of matching predetermined tapered portions for engaging said tapered portion of said wedge shoe to initiate frictional engagement of said friction cushioning means and thereby absorb energy; and (f) a spring release means engaging and longitudinally extending between said seat means and said center wedge for continuously urging said friction cushioning means outwardly from said compressible cushioning means to release said friction cushioning element when an applied force compressing said draft gear is removed.

2. A draft gear assembly, according to claim 1, wherein said compressible cushioning element comprises at least one spring.

3. A draft gear assembly, according to claim 2, wherein said tapered portion of said pair of wedge shoes and said pair of tapered portions of said center wedge are tapered upwardly and outwardly from a plane intersecting the longitudinal centerline of said draft gear assembly at an angle of between 49 degrees and 51 degrees.

4. A draft gear assembly, according to claim 3, wherein said tapered portions are tapered at an angle of between 49 degrees and 50 degrees.

5. A draft gear assembly, according to claim 4, wherein said tapered portions are tapered at an angle of generally 50 degrees.

6. A draft gear assembly, according to claim 2, wherein said compressible cushioning element further comprises a plurality of springs.

7. A draft gear assembly, according to claim 2, wherein said compressible cushioning element further comprises a rubber spring disposed within said at least one spring.

8. A draft gear assembly, according to claim 1, wherein said compressible cushioning element comprises a hydraulic cylinder.

9. A draft gear assembly, according to claim 3, wherein said tapered portion of said pair of wedge shoes and said pair of tapered portions of said center wedge are tapered upwardly and outwardly from a plane intersecting the longitudinal centerline of said draft gear assembly at an angle of about 53 degrees.

10. A draft gear assembly, according to claim 1, wherein said housing further comprises a built-up portion along two opposed sides adjacent said inner surface of said closed end and an inner surface of a connecting sidewall of said housing.

11. A draft gear assembly to cushion shocks encountered in railroad rolling stock, said draft gear assembly comprising:

(a) a housing closed at one end and open at the opposed end, said housing having a rear portion adjacent said closed end and a front portion adjacent said open end, said front portion being in open communication with said rear portion;

(b) at least one compressible spring cushioning element centrally disposed within said rear portion with one end thereof abutting at least a portion of an inner surface of said closed end of said housing, said at least one compressible spring cushioning element extending longitudinally from said one end;

(c) positioning means on said inner surface of said closed end of said housing for centrally maintaining said one end of said at least one compressible spring cushioning element in said rear portion of said housing during compression and extension of said at least one compressible spring cushioning element;

(d) a seat means having at least a portion of one surface thereof abutting the opposite end of said at least one compressible spring cushioning element and mounted to move longitudinally within said housing for respectively compressing and releasing said at least one compressible spring cushioning element during application and release of a force on said draft gear assembly;

(e) a friction cushioning means positioned at least partially within said front portion of said housing for absorbing energy during a compression of said draft gear assembly, said friction cushioning means including:

(i) a pair of laterally spaced outer stationary plates having an outer surface and an opposed inner friction surface, said outer surface engaging said housing, said pair of outer stationary plates having Brinell hardness of between about 277 and 321 throughout, (ii) a pair of laterally spaced movable plates of substantially uniform thickness and having an outer friction surface and an inner friction surface and at least one substantially flat edge intermediate said outer friction and inner friction surfaces, said one edge engaging said seat means, at least a portion of said outer friction surface movably and frictionally engaging said inner friction surface of said outer stationary plate, (iii) a pair of laterally spaced tapered plates having an outer friction and an inner friction surface, said outer friction surface movably and frictionally engaging at least a portion of said inner friction surface of said movable plate, (iv) a pair of laterally spaced wedge shoes having at least a portion of an outer friction surface movably and frictionally engaging at least a portion of an inner friction surface of said tapered plate, and at least a portion of one edge engaging said seat means, said pair of wedge shoes having a tapered portion on an opposed edge thereof which is tapered at an angle of between 49 degrees and 51 degrees, and (v) a center wedge having a pair of matching tapered portions which are tapered at an angle of between 49 degrees and 51 degrees for engaging said tapered portion of said wedge shoe to initiate frictional engagement of said friction cushioning means and thereby absorb energy; and (f) a spring release means engaging and longitudinally extending between said seat means and said center wedge for continuously urging said friction cushioning means outwardly from said at least one compressible spring cushioning element to release said friction cushioning element when an applied force compressing said draft gear is removed.

12. A draft gear assembly, according to claim 11, wherein said tapered portions of said wedge shoes and said center wedge are tapered at an angle of between 49 degrees and 50 degrees.

13. A draft gear assembly, according to claim 12, wherein said tapered portions of said wedge shoes and said center wedge are tapered at an angle of generally 50 degrees.

14. A draft gear assembly, according to claim 11, wherein said at least one compressible spring cushioning element further comprises a plurality of springs.

15. A draft gear assembly, according to claim 14, wherein said at least one compressible spring cushioning element further comprises a rubber spring centrally disposed within said at least one spring.

16. A draft gear assembly to cushion shocks encountered in railroad rolling stock, said draft gear assembly comprising:

(a) a housing closed at one end and open at the opposed end, said housing having a gear portion adjacent said closed end and a front portion adjacent said open end, said front portion being in open communication with said rear portion;

(b) a compressible hydraulic cylinder cushioning element centrally disposed within said rear portion with one end thereof abutting at least a portion of an inner surface of said closed end of said housing, said compressible hydraulic cylinder cushioning element extending longitudinally from said one end;

(c) a positioning means on said inner surface of said closed end of said housing for centrally maintaining said one end of said conpressible hydraulic cylinder cushioning element in said rear portion of said housing during compression and extension of said compressible hydraulic cylinder cushioning element;

(d) a seat means having at least a portion of one surface thereof abutting the opposite end of said compressible hydraulic cylinder cushioning element and mounted to move longitudinally within said housing for respectively compressing and releasing said compressible hydraulic cylinder cushioning element during application and release of a force on said draft gear assembly;

(e) a friction cushioning means positioned at least partially within said front portion of said housing for absorbing energy during a compression of said draft gear assembly, said friction cushioning means including:

(i) a pair of laterally spaced outer stationary plates having an outer surface and an opposed inner friction surface, said outer surface engaging said housing, said pair of outer stationary plates having Brinell hardness of between about 277 and 321 throughout, (ii) a pair of laterally spaced movable plates of substantially uniform thickness and having an outer friction surface and an inner friction surface and at least one substantially flat edge intermediate said outer friction and inner friction surfaces, said one edge engaging said seat means, at least a portion of said outer friction surface movably and frictionally engaging said inner friction surface of said outer stationary plate, (iii) a pair of laterally spaced tapered plates having an outer friction and an inner friction surface, said outer friction surface movably and frictionally engaging at least a portion of said inner friction surface of said movable plate, (iv) a pair of laterally spaced wedge shoes having at least a portion of an outer friction surface movably and frictionally engaging at least a portion of an inner friction surface of said tapered plate, and at least a portion of one edge engaging said seat means, said pair of wedge shoes having a tapered portion on an opposed edge thereof which is tapered at an angle of about 53 degrees, and (v) a center wedge having a pair of matching tapered portions which are tapered at an angle of about 53 degrees for engaging said tapered portion of said wedge shoe to initiate frictional engagement of said friction cushioning means and thereby absorb energy; and (f) a spring release means engaging and longitudinally extending between said seat means and said center wedge for continuously urging said friction cushioning means outwardly from said compressible hydraulic cylinder cushioning element to release said friction cushioning element when an applied force compressing said draft gear is removed.

* * * * *